United States Patent [19]

Skinner, Jr. et al.

[11] 4,154,494

[45] May 15, 1979

[54] PROCESS FOR MANUFACTURING CATHODE RAY TUBE BULBS

[75] Inventors: Charles R. Skinner, Jr., Addison; Walter B. Thomas, III, Horseheads, both of N.Y.

[73] Assignee: Corning Glass Works, Corning, N.Y.

[21] Appl. No.: 799,188

[22] Filed: May 23, 1977

[51] Int. Cl.[2] ..... H01J 9/227; H01J 9/20

[52] U.S. Cl. ..... 316/4; 316/3; 316/12

[58] Field of Search ..... 316/4, 3, 12; 65/43

[56] References Cited

U.S. PATENT DOCUMENTS

| | | | |
|---|---|---|---|
| 3,947,608 | 3/1976 | Duinker et al. | 427/122 X |
| 3,973,975 | 8/1976 | Francel et al. | 106/49 X |
| 4,058,387 | 11/1977 | Nolziger | 65/43 X |

*Primary Examiner*—Richard B. Lazarus

*Attorney, Agent, or Firm*—Kees van der Sterre; Clinton S. Janes, Jr.; Clarence R. Patty, Jr.

[57] ABSTRACT

In a combined bake and seal process for manufacturing a cathode ray tube, wherein screen baking and panel-funnel seaing are accomplished in a single sealing step, chemical reduction of the panel-funnel seaing glass by organic screen components is suppressed by providing an oxygen-evolving agent within the tube during sealing.

1 Claim, 1 Drawing Figure

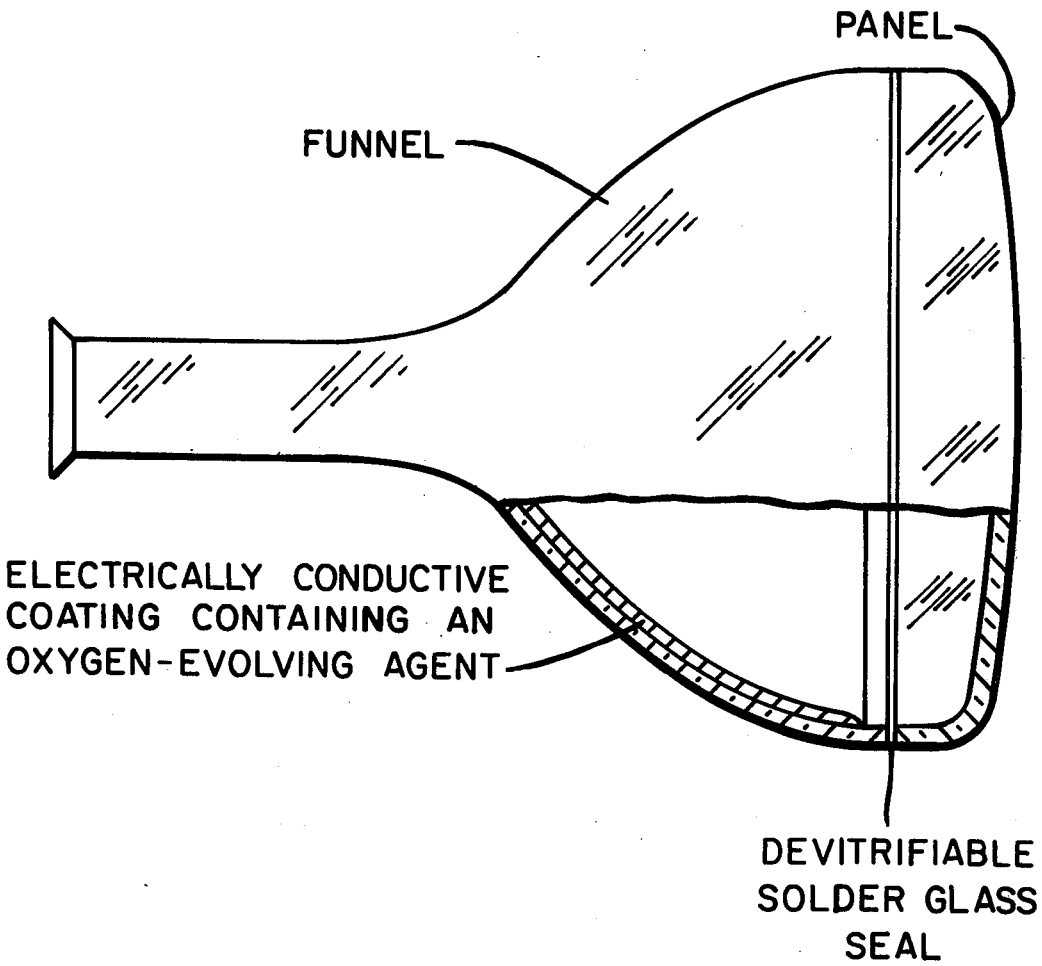
PANEL
FUNNEL
ELECTRICALLY CONDUCTIVE COATING CONTAINING AN OXYGEN-EVOLVING AGENT
DEVITRIFIABLE SOLDER GLASS SEAL

PROCESS FOR MANUFACTURING CATHODE RAY TUBE BULBS

BACKGROUND OF THE INVENTION

The present invention relates to a method for manufacturing cathode ray tubes used for color television picture tubes and the like. Such tubes are presently fabricated by sealing together a glass faceplate or panel supporting the phosphorescent display screen of the tube, and a glass funnel which supports an electrically conductive interior coating constituting part of the electronic circuitry of the tube. Sealing is accomplished by providing a devitrifiable solder glass at the panel-funnel interface which first flows and then crystallizes during heating to provide a hermetic high-use-temperature seal. Following the sealing together of the panel and funnel to provide a bulb assembly, electronic circuitry is added to the bulb and the bulb is evacuated and hermetically sealed to provide an operational cathode ray tube according to procedures well known in the art.

Conventional tube manufacturing processes typically comprise another heating operation, carried out prior to the sealing together of the glass panel and funnel, wherein the glass panel and phosphoresecent display screen are heated to remove organic display screen components applied during the screen deposition process. This heating operation, referred to as screen baking, is carried out at temperatures near those of the subsequent panel-funnel sealing operation.

For the purpose of energy conservation, it would be desirable to accomplish screen baking and the sealing of the glass panel to the glass funnel in a single sealing step, called a combined bake and seal (CBS) operation. Such an operation would eliminate one thermal cycle and reduce tube fabrication energy requirements accordingly.

It is found, however, that organic vapors evolved from the screen components during heaing chemically reduce the devitrifiable solder glass during a combined bake and seal operation. This chemical reduction, evidenced by a dark discoloration of the devitrified seal at and near the interior walls of the sealed bulb, leads to dielectric breakdown of the seal when high voltages (30 kv or greater) are applied across the tube. Such breakdown can ultimately result in seal failure, loss of vacuum, and failure of the tube.

It has been proposed, for example, in U.S. Pat. No. 3,973,975 to Francel et al., to intermix oxidizing agents with the devitrifiable solder glass to suppress chemical reduction by organic vapors during sealing. However, such procedures can be disadvantageous because the addition of those agents, such as red lead, reduced the dielectric strength of the fired solder glass.

The use of alkali and ammonium sulfates and nitrates as additives to modify the properties of interior conductive funnel coatings is suggested in U.S. Pat. No. 3,947,608 to Duinker et al. However, funnels so coated are thereafter incorporated into cathode ray tube envelopes by conventional processing methods.

It is a principal object of the present invention to provide an improved combined bake and seal process which avoids chemical reduction of the solder glass and thus produces a seal which is resistant to dielectric breakdown and hermetic failure.

Other objects of the invention will become apparent from the following detailed description thereof.

SUMMARY OF THE INVENTION

In accordance with the present invention, the chemical reduction of the devitrifiable solder glass during simultaneous screen baking and funnel-panel sealing is minimized by providing an oxygen-evolving agent within the bulb during the bake and seal heating step. This oxygen-evolving agent is an inorganic oxygen-containing compound which is thermally decomposable to yield oxygen upon heating at temperatures of about 400° C. Several such compounds are known. The compound selected for use is provided within the tube in an amount at least effective to suppress chemical reduction of the devitrifiable solder glass during sealing.

It is found that the inclusion of an oxygen-evolving agent in the bulb during sealing prevents excessive reduction of the interior bead and adjacent regions of the devitrified seal by the baked-out components of screen lacquers. Hence, although some dark discoloration evidencing reduction is observed in the interior of the devitrified seal away from the inner wall of the bulb, seal portions at the inner bulb wall exhibit only minor discoloration and are not significantly reduced. Thus the seal resists dielectric breakdown when very high voltages are subsequently applied to the tube.

BRIEF DESCRIPTION OF THE DRAWING

The drawing consists of a schematic partial cut away view of a cathode ray tube bulb of the conventional type which comprises an electrically conductive funnel coating an oxygen-evolving agent.

DETAILED DESCRIPTION

As noted in the background description and illustrated in the drawing, conventional cathode ray tube bulbs typically comprise a glass panel positioned on a glass funnel which supports an electrically conductive funnel coating. The funnel and panel are sealed together with a devitrifiable solder glass.

The presently preferred location for the oxygen-evolving agent within the bulb during sealing is in the electrically conductive funnel coating. The inclusion of this agent in the funnel coating provides good dispersion of the agent in the bulb without the need for auxiliary positioning means. Also, extra processing steps for introducing the agent into the bulb during heating or removing residues subsequent to heating are avoided.

When the oxygen-evolving agent is to be included within the funnel coating, the effects of the agent on coating adherence and electrical performance must be considered. Certain compounds which might otherwise be suitable as oxygen-evolving agents produce residues which unacceptably increase the electrical resistivity of the funnel coating, while other compounds may reduce the bond strength between the funnel coating and the funnel wall.

Thermally decomposable compounds preferred for use as oxygen-evolving funnel coating constituents in accordance with the invention are those selected from the group consisting of potassium nitrate and potassium perchlorate. These compounds do not significantly reduce bond strength or increase coating resistivity, yet are very effective in minimizing chemical reduction of the devitrifiable solder glass. Best results are provided by adding these compounds to the funnel coating composition in an amount constituting about 5–10% by weight, calculated in excess of the weight of the base composition. The particularly preferred additive for this purpose is potassium nitrate.

The effectiveness of any compound incorporated into the funnel coating as an oxygen evolving agent depends in part on the composition and structure of the coating. Commercially utilized funnel coatings are typically relatively soft coatings (Knoop hardness, about 190), provided from suspensions of graphite in an alkali silicate binder. However, harder, more abrasion-resistant coatings (Knoop hardness at least about 350), containing both carbon and iron oxide in a silicate binder, are also used. In general, best results are obtained utilizing oxygen-evolving agents in combination with the aforementioned hard funnel coatings containing carbon and iron oxide.

The nature and amount of organic material present in the phosphorescent display screen also affect the degree to which the oxygen-evolving agent suppresses reduction of the devitrified seal. Organic components of the display screen include lacquers used to protect the deposited phosphors and, in some cases, organic components contained in black matrix materials which may optionally be provided on the screen. Display screens comprising both types of organic components present the most difficult seal reduction problems.

The amount of seal reduction which occurs is also dependent to some extent on the composition of the devitrifiable solder glass. The method of the invention appears to be most effective in suppressing seal reduction in the case of lead-zinc borate solder glasses, but a useful degree of suppression can also be obtained in other solder systems.

Suppression of seal reduction to an extent sufficient to permit the seal to resist dielectric breakdown to 80 kv or more can normally be provided by simply providing a sufficient quantity of oxygen-evolving agent in the tube or funnel coating during sealing. However, where large quantities of organics are present in the unbaked screen, as for example where both screen lacquers and black matrix materials have been deposited, a screen drying step at temperatures in the 25°–100° C. range prior to sealing may be useful in preventing excessive seal reduction. The duration of this drying step depends upon the temperature employed, and may range, for example, from several days at room temperature to 15 minutes or less at 90° C. Brief drying at 90°–100° C. is normally preferred.

The extent to which seal reduction has been suppressed during the combined bake and seal cycle can be estimated by high-voltage testing of sealed bulbs in accordance with a procedure wherein an electric potential is applied across the devitrified seal. A metal strap is positioned around the outside of the sealed bulb over the exterior bead of the devitrified seal, and a voltage is applied between this strap and the conductive funnel coating on the bulb interior. The voltage is increased until dielectric breakdown of the seal occurs.

High-voltage tests on sealed television bulbs subjected to a combined bake and seal cycle at 440° C. without the use of oxygen-evolving agents show a significant reduction in seal dielectric strength. Although the seal dielectric strength of sealed bulbs incorporating screened panels which are separately baked prior to sealing typically exceeds 90 kv, sealed bulbs comprising unbaked panels which include screen lacquers and/or black matrix materials show failures on the order of 50–70 kv when processed through a combined bake and seal cycle.

The following examples show the improvements in seal dielectric strength which may be obtained utilizing combined bake and seal processing in accordance with the invention as hereinabove described.

EXAMPLE 1

A quantity of a funnel coating composition comprising graphite, iron oxide, and an alkali metal silicate binder is modified by adding potassium perchlorate thereto in an amount sufficient to provide a mixture which includes 10% potassium perchlorate by weight. An additional quantity of the same funnel coating composition is modified by incorporating 10% by weight of potassium nitrate therein.

Two glass funnel elements suitable for the fabrication of cathode ray tube bulbs are selected and the interior wall of each funnel is coated with one of the modified funnel coating compositions by brushing. The funnel coatings are then allowed to dry at room temperature.

The sealing edge of each coated funnel is then provided with a coating of a devitrifiable solder glass by extruding a suspension of the solder glass onto the sealing edge. The solder glass suspension consists of 12.5 parts of Corning Code 7590 glass frit and 1 part of an amyl acetate vehicle by weight. Corning Code 7590 glass frit is a devitrifiable lead-zinc borate solder glass, commercially available from Corning Glass Works, Corning, N.Y.

Following the application of the devitrifiable solder glass to each funnel, two glass panels, each panel supporting a coating of unbaked screen lacquer, are positioned on the funnels for sealing. The panel-and-funnel assemblies are then exposed to a combined sealing and screen baking cycle wherein they are heated to a temperature of 440° C. and maintained at that temperature for 40 minutes. This treatment is effective to bake out the lacquer components on the panel and to convert the solder glass to a devitrified seal joining the panel and funnel elements of the bulb. This seal consists of a sealing region defined by the sealing edge of the funnel and bounded by beads along the sealing edge inside and outside of the bulb.

The dielectric strengths of the devitrified seals are tested by applying high voltages across each seal. The bulb having the potassium nitrate-containing funnel coating fails at about 80 kv, while the bulb having the potassium perchlorate-containing funnel coating fails at about 82 kv. These results are in contrast to typical failure voltages of 50–70 kv for bulbs of this configuration processed through a combined bake and seal cycle without providing an oxygen-evolving agent in the bulb interior. Thus the presence of the oxygen-evolving agent in the bulbs minimizes loss of the dielectric strength of the seal.

Examination of sections cut from the seal area of each bulb indicates that significant suppression of chemical reduction of the solder glass within and near the bulb interior during the bake and seal cycle has occurred. The interior seal bead and the adjacent interior sealing areas of the seal are orange in color, not substantially darker than the yellow exterior bead and sealing areas. Only a narrow band of darkened glass, positioned between the yellow exterior and orange interior sealing areas of each devitrified seal, is found to be discolored. This band, being spaced 4–6 mm away from the interior seal bead and near the center of the sealing region, apparently does not act to significantly degrade the electrical performance of the seal.

EXAMPLE 2

Two panel and funnel assemblies comprising lacquer-coated panels and iron oxide/graphite-coated funnels are prepared for sealing as in Example 1 above, except that potassium nitrate and potassium perchlorate are not added to the funnel coating composition. Instead, approximately 10 grams of powdered potassium nitrate is positioned in the yolk area of one bulb, and 10 grams of potassium perchlorate in the yolk area of the other. The assemblies are then exposed to a combined bake and seal cycle in Example 1, comprising heating to 440° C. and holding at 440° C. for 40 minutes to bake out the screen lacquer and seal the panel and funnel components together.

The devitrified seal of each bulb is then tested for dielectric strength as above described. The bulb in which powdered potassium nitrate had been provided resists dielectric seal failure to 90 kv, while the bulb in which the powdered potassium perchlorate had been provided exhibited dielectric seal failure at 76 kv. Inasmuch as the yolk areas of the bulbs do not reach the temperature reached by the seal areas in the particular process employed, repositioning of the agents within the tube to an area adjacent the seals would be expected to enhance these test results.

EXAMPLE 3

The effectiveness of the method of the invention for fabricating tubes utilizing panels comprising both screen lacquers and black matrix materials is demonstrated by sealing and testing twelve panel-and-funnel assemblies utilizing the procedures described in Example 1. However, all of the panels utilized in preparing the assemblies are provided with display screens comprising both unbaked screen lacquer and a layer of black matrix material.

Ten of the funnels used in making the assemblies comprise graphite-iron oxide coatings which include 10% $KNO_3$ by weight as the oxygen-evolving agent. Eight of these funnels and one funnel comprising a graphite-iron oxide coating free of oxygen-evolving agent are combined with panels which have been processed through a screen drying step as hereinabove described. The remaining three funnels, including one containing $KNO_3$ in the coating and two with graphite-iron oxide coatings free of $KNO_3$, are combined with undried panels. All of thepanel-and-funnel assemblies are then exposed to a combined bake and seal cycle as in Example 1, comprising heating to 440° C. and holding at 440° C. for 40 minutes. Following sealing, the sealed assemblies are subjected to high-voltage testing to evaluate the dielectric strength of each seal as hereinabove described.

The results of dielectric seal testing for the assemblies processed as described are set forth in Table I below. In addition to dielectric seal breakdown voltages for seals failing during testing, the presence or absence of oxygen-evolving agents and details of screen drying steps, where employed, are reported.

TABLE I

| Assembly Number | Screen Organics | Drying Step | Oxygen Evolving Agent | Dielectric Seal Failure Voltage |
|---|---|---|---|---|
| 1 | All | None | None | 60 kv |
| 2 | include lacquer plus black matrix coating | None | 10% $KNO_3$ | 58 kv |
| 3 | | None | 10% $KNO_3$ | 70 kv |
| 4 | | 90° C.-15 min. | None | 70 kv |
| 5 | | 25° C.-15 hrs. | 10% $KNO_3$ | >90 kv |
| 6 | | 90° C.-120 min. | 10% $KNO_3$ | 86 kv |
| 7 | | 90° C.-30 min. | 10% $KNO_3$ | 80 kv |
| 8 | | 90° C.-15 min. | 10% $KNO_3$ | 84 kv |
| 9 | | 90° C.-15 min. | 10% $KNO_3$ | 70 kv |
| 10 | | 90° C.-15 min. | 10% $KNO_3$ | 90 kv |
| 11 | | 90° C.-15 min. | 10% $KNO_3$ | 90 kv |
| 12 | | 90° C.-15 min. | 10% $KNO_3$ | >100 kv |

From the foregoing data it appears that, in cases where the phosphorescent display screen includes a layer of black matrix material, seal reduction can be effectively suppressed in a combined bake and seal process if both a screen drying step prior to sealing and an oxygen-evolving agent are utilized. Drying temperatures in the range of about 25°–100° C. for times in the range of about 15 minutes to 24 hours, depending on temperature, appear to provide the most satisfactory results. However, drying is both time and temperature dependent so that, at lower temperatures in the preferred range, relatively long drying times should be used.

EXAMPLE 4

Two unbaked panels comprising display screens which include both a screen lacquer and a black matrix material are preliminarily dried at 90° C. for 15 minutes in preparation for sealing. These two panels are then combined with coated funnels in accordance with the procedure described in Example 1. However, the funnel coatings on the funnels used in the assemblies are soft coatings provided from a graphite-containing alkali silicate suspension. These coatings include 10% $KNO_3$ by weight, but are free of iron oxide.

After assembly, the panel-funnel combinations described are processed through a combined bake and seal cycle as in Example 1, which cycle comprises heating to 440° C. and holding at 440° C. for 40 minutes, followed by cooling. The sealed panel-funnel assemblies are then subjected to high voltage testing as in Example 1, with dielectric seal failure occuring at 70 kv in the case of one assembly and 83 kv in the case of the other. These results are superior to those obtained when no oxygen-evolving agent is present in the soft funnel coatings during the bake and seal process.

From the foregoing description it is apparent that a combined bake and seal process wherein an oxygen-evolving agent is provided within the bulb, and specifically within the funnel coating of the bulb, constitutes a useful advance in the cathode ray tube fabricating art.

We claim:

1. In a process for the fabrication of a cathode ray tube bulb having a glass panel supporting a phosphorescent display screen including a black matrix material, which panel is sealed to a glass funnel supporting an electrically conductive interior funnel coating, said process comprising the steps of (a) depositing the display screen and black matrix material on the panel, (b) applying a layer of a devitrifiable solder glass to a sealing edge on the panel or funnel, said devitrifiable solder glass being subject to chemical reduction on heating, (c) positioning the panel against the funnel, and (d) heating the panel, screen, funnel and devitrifiable solder glass to simultaneously remove organic components from the screen and seal the panel to the funnel, the improvements which comprise the steps of:

prior to heating, drying the glass panel with screen and black matrix material at a temperature in the range of 25°–100° C. for a time interval of ¼–24 hours, and introducing an oxygen-evolving agent consisting of potassium nitrate or potassium perchlorate into the electrically conductive interior funnel coating prior to the step of heating the panel, screen, funnel and devitrifiable solder glass, said oxygen-evolving agent being introduced into the coating in an amount effective to suppress chemical reduction of said devitrifiable solder glass by organic components from the screen and black matrix during heating.

* * * * *

UNITED STATES PATENT AND TRADEMARK OFFICE

CERTIFICATE OF CORRECTION

PATENT NO. : 4,154,494

DATED : May 15, 1979

INVENTOR(S) : Charles R. Skinner, Jr. and Walter B. Thomas, III

It is certified that error appears in the above-identified patent and that said Letters Patent are hereby corrected as shown below:

Abstract, line 4, change "seaing" to --sealing--.

Column 1, line 25, change "phosphoresecent" to --phosphorescent--.

Column 1, line 39, change "heaing" to --heating--.

Column 5, line 9, change "yolk" to --yoke--.

Column 5, line 10, change "yolk" to --yoke--.

Column 5, line 22, change "yolk" to --yoke--.

Column 6, line 54, change "occuring" to --occurring--.

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*